US005727333A

United States Patent [19]

Folan

[11] Patent Number: 5,727,333

[45] Date of Patent: Mar. 17, 1998

[54] PROCESS FOR DRYING A MATERIAL FROM SOLUTION

[75] Inventor: Michael Anthony Folan, Donegal Town, Ireland

[73] Assignee: Kinerton Limited, Dublin, Ireland

[21] Appl. No.: 669,565

[22] PCT Filed: Jan. 31, 1995

[86] PCT No.: PCT/IE95/00013

§ 371 Date: Nov. 4, 1996

§ 102(e) Date: Nov. 4, 1996

[87] PCT Pub. No.: WO95/22036

PCT Pub. Date: Aug. 17, 1995

[30] Foreign Application Priority Data

Feb. 9, 1994 [IE] Ireland ..... 940116

[51] Int. Cl.[6] ..... F26B 5/06

[52] U.S. Cl. ..... 34/285; 34/288; 34/92

[58] Field of Search ..... 34/285, 287, 288, 34/289, 290, 295, 299, 92; 62/100, 268

[56] References Cited

U.S. PATENT DOCUMENTS

| | | | |
|---|---|---|---|
| 2,471,035 | 5/1949 | Hurd | 34/92 |
| 3,313,032 | 4/1967 | Malecki | 34/5 |
| 3,319,344 | 5/1967 | Sachsel et al. | 34/5 |
| 3,362,835 | 1/1968 | Thuse et al. | 99/199 |
| 3,621,587 | 11/1971 | Smith, Jr. | 34/92 |
| 3,633,283 | 1/1972 | Mishkin et al. | 34/73 |
| 3,909,957 | 10/1975 | Passey | 34/92 |
| 3,932,943 | 1/1976 | Briggs et al. | 34/287 |
| 4,033,048 | 7/1977 | Van Ike | 34/92 |
| 4,823,478 | 4/1989 | Thompson, Sr. | 34/287 |
| 4,848,094 | 7/1989 | Davis et al. | 34/287 |
| 5,208,998 | 5/1993 | Oyler, Jr. | 34/288 |
| 5,230,162 | 7/1993 | Oyler, Jr. | 34/5 |
| 5,248,905 | 9/1993 | Beurel et al. | 34/92 X |
| 5,257,657 | 11/1993 | Gore | 164/46 |

FOREIGN PATENT DOCUMENTS

| | | |
|---|---|---|
| 1449444 | 7/1966 | France . |
| 2016600 | 8/1970 | France . |
| 3105623 A1 | 9/1982 | Germany . |
| 4113512 A1 | 10/1992 | Germany . |
| 1 275 381 | 5/1972 | United Kingdom . |

*Primary Examiner*—Henry A. Bennett
*Assistant Examiner*—Steve Gravini
*Attorney, Agent, or Firm*—Fish & Richardson P.C.

[57] ABSTRACT

A process for drying a solution containing the material. The process includes the following steps: (1) subjecting the solution to vacuum-assisted freezing by introducing the solution into an evacuated chamber in the form of a spray, the droplets of which are at a sufficiently low temperature to ensure that they freeze at the vacuum pressure inside the chamber; (2) collecting the frozen droplets of the solution on a collecting surface of the chamber and controlling the temperature of the collecting surface and the pressure within the chamber so that the frozen solvent sublimes from the collected frozen droplets. The collecting surface is prepared by being brought to an initial temperature which is not greater than the melting point of the frozen solution at the initial pressure, which is the pressure within the chamber when the spray is introduced, the temperature of the collecting surface and the pressure within the chamber being maintained throughout the sublimation process so as to prevent partial remelting of the frozen droplets as sublimation occurs

20 Claims, 2 Drawing Sheets

PROCESS FOR DRYING A MATERIAL FROM SOLUTION

TECHNICAL FIELD

This invention relates to a process for obtaining a solid or semi-solid material by drying a solution thereof.

BACKGROUND ART

In many processes used in industry and research facilities involving areas such as pharmaceuticals, healthcare, food and cosmetics, there is a requirement to extract, modify or synthesize a product or products in solution. Following these activities there is frequently a requirement to dry the product (s) by removal from the solution. The drying processes used can be either single step or multiple step processes involving, inter alia, precipitation, centrifugation, evaporation, increased temperature, hot airstreams or fluidised bed vibration. The resulting solid material is in the form of a powder or cake, the particle size of which is largely dependent upon the chosen technique. The particle size influences the further processing, storage, handling, transport and application of the material. Many applications require mean particle diameters of less than 100 μm. Since great care is needed to achieve such a particle size, milling or grinding of the dried powder is frequently used to reduce mean particle diameter.

Control of the particle size is vital for many applications in the pharmaceutical industry, where the size of the particle of an active drug substance or excipient can influence the efficacy of a medication. For example, in a metered dose inhaler which is used to treat asthmatic attacks, a modified aerosol system is used to deliver an aerosol of finely dispersed drug substance to the upper respiratory tract. In order to penetrate to the bronchi it is known that the particle size of the drug substance in the aerosol should be in the region of 2 μm.

The optimum release profiles for many formulations for both oral and parenteral administration require the use of delayed, controlled or sustained release particles. This is frequently achieved using some form of micro-encapsulation, wherein finely dispersed particles of the active substance are coated with a biodegradable coating which facilitates slow or sustained release of the active substance. In order to inject a suspension of microcapsules in a carrier liquid, the microcapsules must be sufficiently small to travel through a small bore needle without blocking it. This may require drug particles of 10 μm or less.

The transdermal administration of many drugs is also facilitated by the provision of reduced particle size. Transdermal migration of an active substance is heavily dependent on the concentration gradient of the active substance across the skin. The greatest concentration at the surface of the skin is achieved by a solid in close proximity thereto. A smaller particle size results in a greater surface area of solid in contact with the skin. In addition, finer particles are more closely associated with the pores of the skin, facilitating faster dissolution and transdermal migration.

Ointments, lotions and creams designed for topical application may contain a suspension of a solid active substance. The particle size of a suspended solid dictates the "feel" of the preparation. Coarse or gritty particles which are detectable by feel on application reduce the desirability of the preparation and hence reduced particle size is a requirement.

In a suspension, reduced particle size of a suspended solid will cause a delay in settling out and will facilitate rapid re-dispersion on shaking, thereby enhancing the homogeneity of the preparation.

Similar considerations apply in the cosmetics and food industries as in the case of the pharmaceutical industry, particularly in the applications of flavours, fragrances and colourings. Again, it is frequently desirable to provide a very finely dispersed solid or even to achieve a micro-encapsulation of such ingredients.

A large number of substances used in the pharmaceutical, healthcare, food and cosmetics industries are thermolabile, i.e. susceptible to denaturation by heat. Particular care is required in drying these substances: the method most frequently chosen is freeze-drying or lyophilisation.

The process of lyophilisation is well known to those skilled in the art. It is reviewed in "The physico-chemical basis for the freeze-drying process", A. P. MacKenzie, Develop. Biol. Standard, 36, 51–67 (S. Karger, Basel 1977). In this process a solution of the material is frozen, after which the temperature and pressure are adjusted in order to allow the solvent to sublime. The residual solid is in the form of a fine matrix within which there is a network of inter-particulate spaces to which the solvent can be readily reintroduced. This end product is in the form of an intact dried cake. By its very nature the process of lyophilisation is not suited to manipulation of particle size. However, since lyophilisation is the gentlest method of drying a thermolabile material, many industries resort to milling the freeze-dried cake to produce the required particle size. Since milling itself has the potential to generate heat and denature sensitive material, modern milling of a thermolabile material frequently necessitates the use of "fluid jet milling". In this process, a jet of air or cooled nitrogen gas is used to mill particles entrained therein by accelerating the entrained particles and causing them to collide.

In the case of a material which is stable at elevated temperatures, the standard industry technique for drying the material to controlled particle size is spray drying. A review of the technique is provided in "The process of spray drying and spray congealing", M. J. Killeen, Pharmaceutical Engineering, August 1993, 55–64. In this process, a solution of the material is introduced into the drying chamber at atmospheric pressure through a nozzle designed to create a fine mist or aerosol. The spray particles are carried in a stream of air at elevated temperature, causing the evaporation of the solvent, resulting in dried particles. However, removal of the particles from the stream of hot air and solvent vapour, which usually takes place in a cyclonic device designed to separate the particles via centrifugation, can result in loss of material. With very fine particles there is insufficient mass to achieve the necessary centrifugal force which would enable the particles to leave the air-stream; particles are therefore carried out the exhaust. When seeking to achieve particles of 10 μm diameter or less losses of 30% are not uncommon. Such losses are economically unacceptable with modem high value pharmaceuticals, flavours and fragrances.

DISCLOSURE OF INVENTION

According to the invention, there is provided a process for obtaining a solid or semi-solid material by drying a solution thereof, comprising the steps of:

(a) subjecting the solution to vacuum-assisted freezing by introducing the solution into an evacuated chamber in the form of a uniform spray, the droplets of which are at a sufficiently low temperature to ensure that they freeze at the vacuum pressure inside the chamber; and (b) collecting the frozen droplets of solution on a collecting surface which is positioned in the chamber such that it collects the frozen solution and which is adapted to retain the droplets until they have been dried by sublimation, and controlling the temperature of the collecting surface and the pressure within the chamber so that the frozen solvent sublimes from the collected and retained frozen droplets, the collecting surface having been prepared by being brought to an initial temperature which is not greater than the melting point of the frozen solution at the initial pressure, which is the pressure within the chamber when the spray is introduced thereto, the temperature of the collecting surface and the pressure within the chamber being maintained throughout the sublimation process so as to prevent partial remelting of the frozen droplets as sublimation occurs.

The term "spray" as used in this Specification includes a spray, an aerosol, a shower, a mist, an atomised dispersal and any other dispersal of solution which will freeze on being introduced to the evacuated chamber. The term "droplet" refers to a particle of solution in any such spray.

It will be seen that such a process provides an integrated method of drying a substance, including a thermolabile substance. In preferred embodiments the process results in very small particles of dried substance being obtained, without requiring the extra step of milling or grinding, and thereby avoiding the losses associated therewith.

It will be apparent to those skilled in the art that expanding a droplet of solution into a vacuum causes the evaporation of solvent from the surface of the droplet. Associated with this evaporation is a heat loss due to the latent heat of vaporisation. As heat is lost with the evaporating solvent, the droplet cools down towards its freezing point. When a sufficient heat loss has occurred, the droplet freezes. It can be seen that a suitable choice of initial solution temperature, droplet size and vacuum will result in the droplet freezing very quickly upon introduction to the chamber.

Suitably, the process may further comprise the step of cooling the solution, before it is introduced into the evacuated chamber, to a temperature just above the equilibrium freezing point of the solution.

Alternatively, the process may further comprise the step of supercooling the solution before it is introduced into the evacuated chamber.

The step of supercooling may be achieved by stirring the solution as it is cooled below its equilibrium freezing point. Alternatively, the solution may be frozen in a container and subjected to pressure which causes the frozen solution to partially or totally remelt to a supercooled state, whereupon the supercooled solution is admitted to the vacuum. The latter method allows the attainment of very cold liquid solutions to be achieved.

For example, an aqueous solution may be frozen in a thick-walled container to −20° C. or less. If the frozen mass is sufficiently compressed from above, the solution at the base of the container will melt without substantial warming. The supercooled liquid can be admitted, via a narrow aperture, from the base of the container into the vacuum chamber, whereupon it will undergo almost instantaneous freezing, due to both its very low temperature and the vacuum within the chamber.

Either of the steps of cooling or supercooling may be used to bring the solution to the correct temperature. Whether or not these steps are needed depends on, inter alia, the initial temperature of the solution, the nature of the solution, the pressure of the chamber and the speed at which freezing must occur.

The initial cooling of the collecting surface allows the finished product to remain in the form of particles which correspond in size to the original spray droplets. If the collecting surface is above the melting point of the frozen solvent, there may be partial melting of the frozen droplets (reducing the control over particle size).

By retaining the droplets in frozen form, there is an additional benefit, since the total solid surface area is maximised, speeding the sublimation process.

Preferably, the initial temperature of the collecting surface is such that sublimation of the solvent commences when the frozen droplets of solution contact the collecting surface.

In this way, the preparation of the chamber can be achieved by refrigerating the collecting surface and evacuating the chamber, whereby the spray, when introduced, freezes, falls and sublimes as pan of a continuous process. It is necessary only to ensure that the rate of sublimation is not so high that the particles of spray are removed with the sublimed vapour.

The size of the dried particle is partially controlled by the speed of ice crystal formation. The speed of crystal formation is a determining factor in the size of the crystals formed; since the solute is concentrated at the faces of the ice crystals, smaller crystals provide smaller inter-crystal spaces and hence smaller particles of dried solute when the frozen solvent has been removed by sublimation). In seeking to attain very small particles therefore, it is desirable to effect almost instantaneous freezing of the entire droplet.

Instantaneous freezing is usually almost impossible to achieve with conventional freeze drying of liquids as the formation of ice is itself exothermic liberating heat of crystallisation which slows the advancing ice layer, promoting a more extensive filigree of ice crystal lattice. However, in the process of "decompression freezing" outlined above, cooling due to initial evaporation is followed by exothermic ice-nucleation which will cause further evaporation of the remaining liquid, in turn resulting in the freezing of the residual liquid. Thus, in decompression freezing, heat of crystallisation promotes further drying by causing the evaporation of residual liquid, resulting in near instantaneous freezing of the droplet under vacuum.

Furthermore, in the process according to the invention, it will be appreciated that the rapid freezing of small particles is facilitated by the higher relative surface area of the corresponding droplets. Evaporation of liquid takes place at the surface of the droplet; the corresponding loss of heat results in the freezing of the volume of liquid constituting the droplet. The time taken for a droplet to freeze is therefore dependent on both the surface area and the volume of the droplet. Rapid freezing requires a rapid loss of heat (a large surface area) per unit volume. The most desirable case, therefore, is that in which the ratio of surface area/evaporation) to volume (freezing) is high. In the case of a spray droplet in the form of a sphere, this ratio is inversely proportional to the radius of the sphere, and so the process is particularly suitable for producing very small particles.

Therefore, preferably, the initial pressure is such that the freezing of the solution, when introduced to the chamber, is substantially instantaneous.

Suitably, the material obtained is in the form of particles which correspond in size to the original droplets of spray.

According to the invention, the particle size may be controlled by the rate of freezing of the droplets. Thus, while rapid freezing is preferred for many applications, the rate of freezing may be adjusted to suit the requirements for the finished material.

As indicated above, this instantaneous freezing can be achieved by choosing the vacuum pressure with reference to the droplet size and solution temperature.

The dimensions of the chamber dictate the distance between the spray nozzle and the collecting surface. It will be appreciated that the droplet should travel through the vacuum and achieve a frozen state before contacting the collecting surface. If freezing has not been completed between the point of entry and the collecting surface amalgamation of droplets will occur resulting in greatly increased particle size.

According to a preferred embodiment, the solvent vapour, after sublimation, is recovered on a condenser the surface temperature of which is kept below that of the collecting surface throughout the sublimation step.

In the latter embodiment, the driving force for the sublimation process is the differential between the vapour pressure of the evaporated solvent over the frozen solvent and the vapour pressure the evaporated solvent over the condenser.

According to a preferred embodiment, the pressure within the chamber remains constant throughout the freezing and sublimation steps.

By holding the pressure constant throughout the process, and especially when the collecting surface is also held at a temperature at which sublimation will occur at the constant pressure, the result is a single step process, wherein the pressure and temperature need only be changed upon recovery of the material.

According to another preferred embodiment, the pressure within the chamber is controlled using a calibrated leak. It will be apparent to those skilled in the an of freeze drying that a calibrated leakage of air or a suitable gas into the vacuum chamber enhances the rate of sublimation by providing means for the transfer of heat to the drying material or within the drying material in order to offset the heat loss and temperature decrease associated with sublimation.

The process of sublimation is endothermic: the tendency is for the temperature of the frozen solution to decrease after the onset of sublimation. This in turn reduces the vapour pressure of the solvent over the frozen solution, reducing the rate and amount of solvent which can be removed by sublimation.

For this reason, preferably, the controlling of the temperature of the collecting surface and of the pressure within the chamber ensures initially that the sublimation of the frozen solvent proceeds substantially to completion, and subsequently that the residual material is sufficiently heated to drive off substantially all remaining adsorbed solvent.

Ensuring that the sublimation proceeds substantially to completion can be achieved by requiring that the controlling of the temperature of the collecting surface includes a step wherein the temperature of the surface is adjusted to compensate for the cooling effect of sublimation of the frozen solvent.

The collecting surface could, therefore, be provided with both heating and cooling means. A process of feedback would ensure that the temperature remains within a narrow range of temperatures, allowing the optimum amount of sublimation.

Even after all of the solvent which can be removed by sublimation has been removed, there is usually a small amount of adsorbed solvent on the material. Depending upon both the material and the solvent, by warming the material to a greater or lesser degree under vacuum, this solvent will be removed. For example, in the case of a thermolabile substance dried from water, a temperature of only 20°–30° C. is needed, under sufficient vacuum, to remove all of the water.

The solvent may be any substance in which the material to be dried will dissolve and which will undergo sublimation under the correct conditions of temperature and pressure. Thus, the solvent may be selected from inorganic solvents, organic solvents or a mixture thereof. Representative examples of inorganic solvents include water, ammonia, sodium hydroxide and nitric acid. Representative examples of organic solvents include ether, benzene, acetone, formic acid, acetic acid and lactic acid. Suitably, the mixtures may be dilute acidic or basic solutions, for example an aqueous solution of sodium hydroxide, or they may be mixtures or solutions of organic and/or inorganic solvents.

Suitably, the solution further comprises a volatile solvent such that the vacuum-assisted freezing of the spray of solution is accelerated by the rapid evaporation of the volatile solvent.

For example, the rate of freezing of an aqueous solution under vacuum is increased by the addition of ethanol to the solution. A spray of solution containing equal amounts of water and ethanol will freeze with the loss of heat associated with the evaporation of most of the ethanol. The residual ethanol in the frozen aqueous droplets is carried away with the subliming water vapour in an azeotropic mixture.

Although the process may be used for drying any type of solute from a suitable solvent, the process has particular applications when the material is a thermolabile substance and when the material comprises biological material.

The process also provides a method of drying a material in the absence of air, this will have particular benefit where material is easily oxidized or denatured by atmospheric gases or where it is desired to obtain the dried material in a form which does not contain atmospheric gases.

The process also has a particular application when the solution comprises two miscible solvents, each containing a solute soluble in one solvent but not in the other.

If, for example, the solution comprises both an aqueous and an organic solvent, the solution can be dried in such a way that the organic phase evaporates leaving its solute deposited in or coated on the aqueous phase constituents or vice versa. This process leads to the concept of vacuum-assisted cryogenic spheronisation, wherein microencapsulation and drying are achieved in one step.

Furthermore, the solution may comprise two solutes, both of which are recovered from the solution.

In this case, evaporation and sublimation of the solvent will result in particles being obtained comprising a mixture of both solutes. The same considerations will apply for three or more materials dissolved in the same solution.

Since the particle size is determined by the size of the droplet upon freezing, the droplets of spray may preferably have a mean diameter of 100 μm or less. The preferred size of droplet depends upon the application to which the material is to be put; the mean diameter of the droplets may suitably be 20 μm or less, or even 5 μm or less.

Suitably, the material may undergo one or more stages of further processing under vacuum before being recovered. Thus, if further processes can be suitably carried out under vacuum, the starting material for these processes will be the material, under vacuum, in a pure form, thereby eliminating the need for further handling steps and the associated risks of denaturation, adsorption, absorption, contamination, loss of product, etc.

According to the invention, there is also provided a drying apparatus for obtaining a solid or semi-solid material by drying a solution thereof, comprising:

a) a vacuum chamber into which a solution is introduced in the form of a spray;

b) means for evacuating the chamber to a sufficiently low pressure to cause the droplets of spray to undergo vacuum-assisted freezing upon introduction to the chamber;

c) a collecting surface positioned in the chamber such that it collects the frozen solution and a first temperature control means for controlling the temperature of the collecting surface, the collecting surface being adapted to retain the frozen droplets thereon until they have been dried by sublimation; and d) means for controlling the vacuum pressure such that sublimation of the frozen solvent takes place from the frozen solution.

Suitably, the apparatus further comprises a second temperature control means for controlling the temperature of the solution before it is introduced into the vacuum chamber.

Sublimation of the frozen solvent is facilitated when using the apparatus according to the invention if the chamber further comprises a condenser for condensing the solvent vapour.

Preferred types of condenser include a liquid nitrogen trap or a refrigerated coil.

The choice of the location and the nature of the condenser will be determined by the requirements of the system, the nature and volume of the solvent and the rate at which the solvent is to be removed.

As the rate of sublimation is a function of the difference in vapour pressure between the vapour over the collecting surface and the vapour over the surface of the condenser, a preferred embodiment comprises a third temperature control means for controlling the temperature of the condenser.

According to a preferred embodiment, the means for controlling the vacuum pressure comprises means for providing a calibrated leak into the vacuum chamber.

The collecting surface is preferably one or more of the walls of the vacuum chamber. In this case, the vacuum chamber as a whole may be refrigerated; when the solution is sprayed in, the frozen droplets are collected on the wall or walls and sublimation takes place therefrom.

As an alternative, the collecting surface is a removable tray positioned within the vacuum chamber to collect the frozen droplets.

This will allow the material to be deposited onto a removable, sterile surface; the material can then be removed from the chamber upon completion of the drying process, thereby minimising the possibilities of contamination or loss of product.

Suitably, the drying apparatus further comprises a spray nozzle for introducing the solution into the vacuum chamber in the form of a spray.

Preferably, the apparatus further comprises means for feeding the solution to the nozzle.

Suitably, the means for feeding the solution to the nozzle may employ gravity to feed the solution.

Preferably, the means for feeding the solution to the nozzle comprises either a piston arrangement or a pump.

Most preferably, the means for feeding the solution to the nozzle comprises means for freezing the solution and compressing the frozen solution in a container communicating with the nozzle.

According to a preferred embodiment of the apparatus, the means for feeding the solution to the nozzle comprises means for cutting off the feeding of solution before any air is admitted to the chamber.

In the case where the solution would be liable to freeze in the nozzle, this may be avoided by providing a rotating centrifugal nozzle or an intermittent plunger to clear the aperture of the nozzle of frozen solution. Alternatively, an outer jacket having a controlled temperature fluid therein can be employed, said jacket surrounding the nozzle in order to melt any frozen solution therein.

According to a preferred embodiment of the invention the apparatus further comprises means for increasing the temperature of the dried solute after sublimation has taken place such that substantially all adsorbed solvent is removed from the solute.

It will be appreciated by those skilled in the art that the drying apparatus described above, in each of its embodiments, may be used in carrying out the process according to the invention.

BRIEF DESCRIPTION OF DRAWINGS

The invention will be further illustrated by the following description of an embodiment thereof, given by way of example only with reference to the accompanying drawings in which.

BEST MODE FOR CARRYING OUT THE INVENTION

Figure 1:
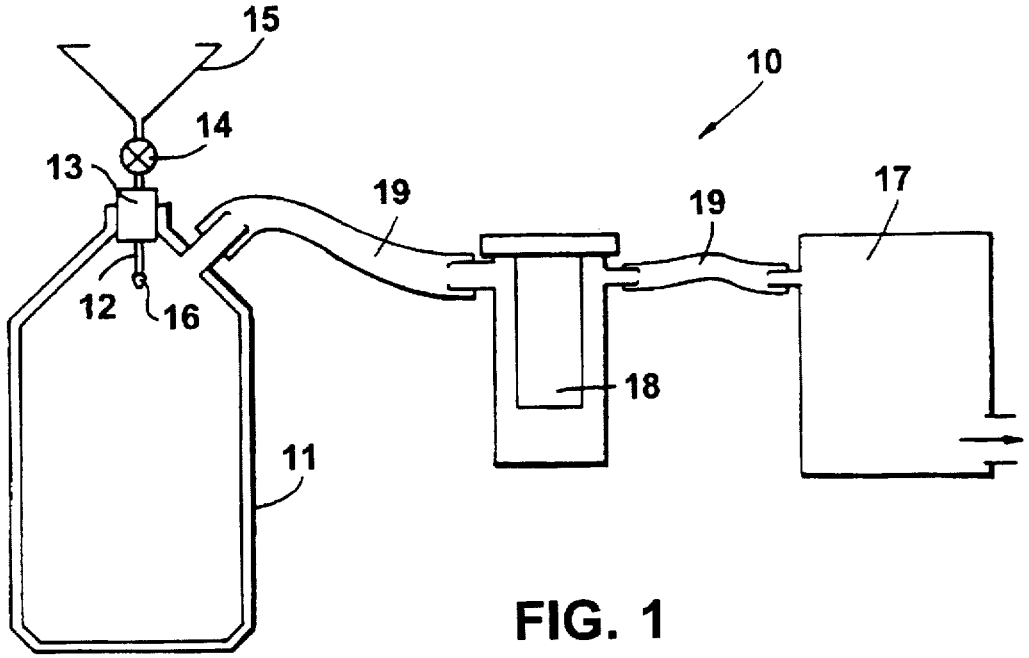
FIG. 1 is a schematic representation of a laboratory-scale apparatus according to the invention.

In FIG. 1, there is shown generally at 10 a laboratory-scale embodiment of a drying apparatus according to the invention. The apparatus 10 comprises a five liter vacuum flask 11 having a rigid plastics tube 12 of approximately 1.0 cm internal diameter extending through a rubber stopper 13 which is fitted to the top of the flask 11 to form a gas-tight seal. A two-way glass stopcock 14 is attached to the top of the tube 12 as close to the robber stopper 13 as possible. A plastics laboratory funnel 15 is fixed above the stopcock 14. A plastics atomiser nozzle 16 is affixed to the bottom of the tube 12. A vacuum pump 17 having a condenser 18 in the form of a liquid nitrogen trap is connected to the vacuum flask 11 such that any gases or vapours removed from the flask 11 are extracted through the condenser 18. Vacuum tubing 19 is used as a conduit for the gases and vapours in the evacuated part of the apparatus 10.

EXAMPLE

The drying apparatus illustrated in FIG. 1 was used, in carrying out the process according to the invention, to dry a 100 ml sample of 2% w/v aqueous solution of egg albumin. This solution was prepared by cooling to 1° C. The funnel 15, stopcock 14, rubber stopper 13, plastics tube 12 and nozzle 16 were prepared by refrigeration to 1° C.; and the vacuum flask 11 was prepared by refrigeration to −25° C.

The apparatus was assembled with the stopcock 14 closed and a vacuum of 10 Pa (0.1 mbar) was established in the vacuum flask 11. The funnel 15 was filled with the prepared solution. The solution was introduced into the flask 11 via the plastics tube 12 and nozzle 16 by opening the stopcock 14, taking care to close the stopcock 14 before all of the solution had entered. This is because if the funnel is drained, air will be admitted thereafter destroying the vacuum. The spray of solution immediately froze and settled on the sides and bottom of the flask 11. Sublimation began immediately.

When all of the available water vapour had been drawn off by sublimation, the flask 11 was allowed to slowly warm to room temperature while the vacuum was maintained. This allowed any adsorbed water to be removed from the albumin. When ambient temperature was established, air was admitted into the flask 11 and the dried albumin was removed.

For the purposes of comparison, lyophilisation was carried out using an aliquot of the same sample of egg albumin at the same concentration. 100 ml of 2% egg albumin was frozen to −20° C. and dried by sublimation under vacuum at 10 Pa (0.1 mBar) in a Virtis laboratory scale freeze drier.

Milling was not used to alter the final particle size of either sample. Particle size analysis was carried out in silicon oil using a Malvern Mastersizer E version 1.2a.

Figure 2:
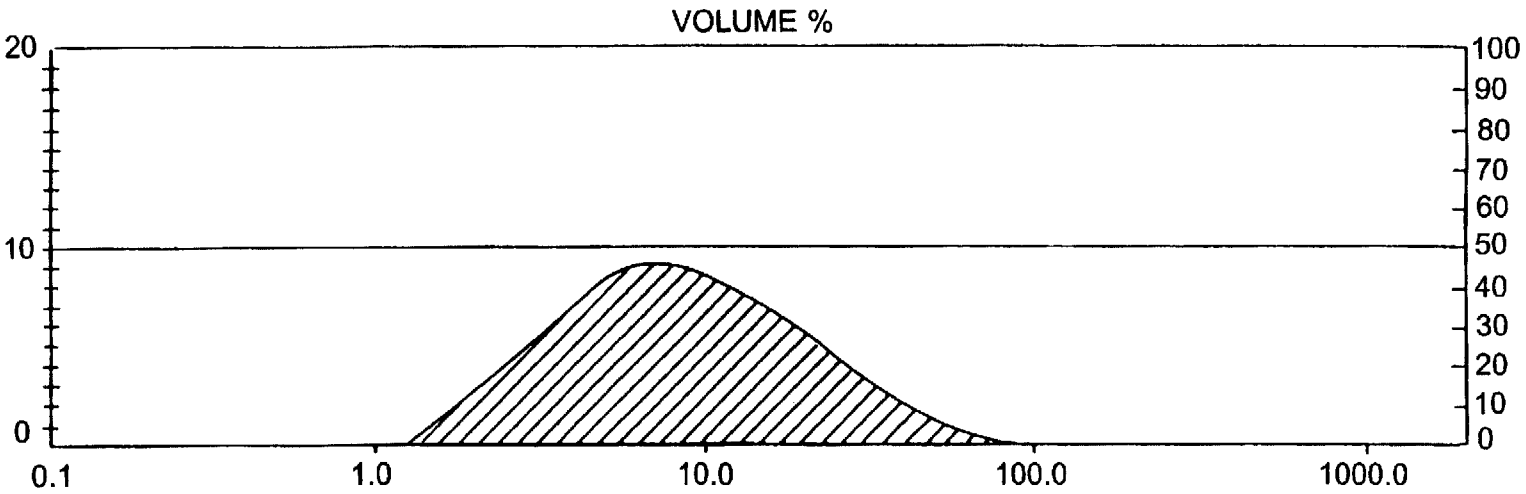
FIG. 2 shows the distribution of particle diameter of a product obtained by the process according to the invention.
Figure 3:
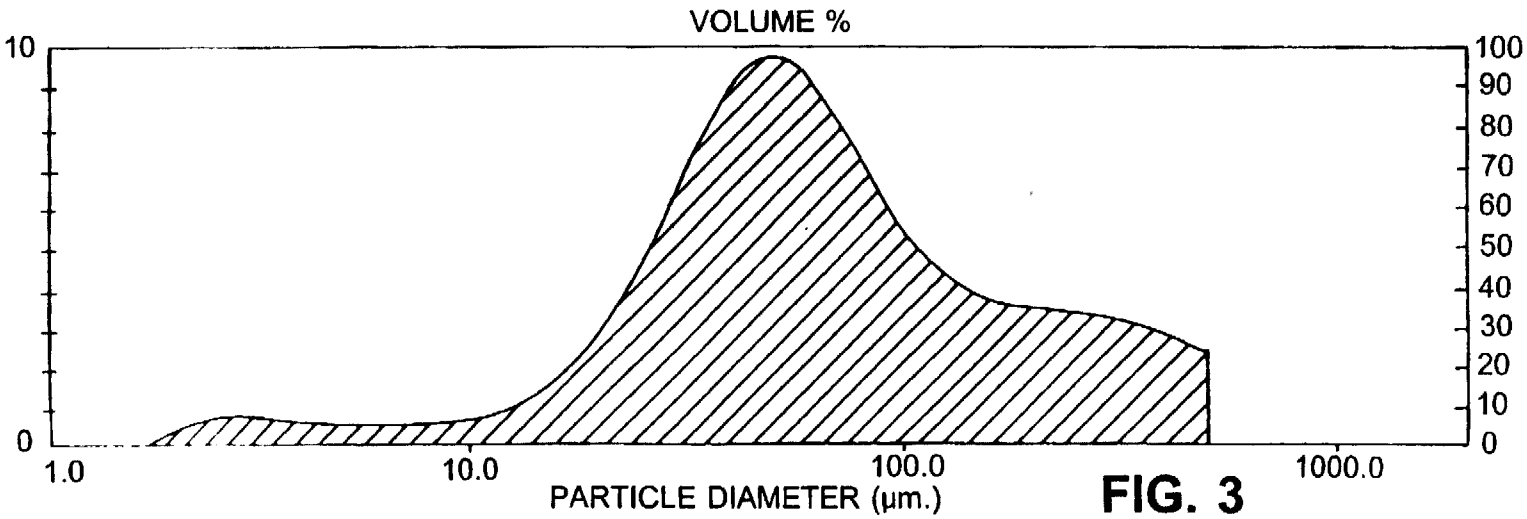
FIG. 3 shows the distribution of particle diameter of the same product the subject of FIG. 2 when obtained by conventional lyophilisation.

FIG. 2 shows the results of the particle diameter analysis for the powder prepared in the Example using the process and apparatus according to the invention. A mean particle diameter of 11.69 μm was obtained; in comparison, a similar analysis of the particles obtained by lyophilisation of the solution indicated a mean particle diameter of 61.29 μm, as illustrated in FIG. 3.

Using Differential Scanning Calorimetry (DSC) it is possible to demonstrate a morphological difference between samples of the same material dried by conventional lyophilisation and by spray freezing in accordance with the present invention. A DuPont model 912 DSC with Duran sample head and Thermal Analysis System 2000 was used to compare samples using a heating ramp from 35° C. to 150° C. The lyophilised material exhibited an endothermic event at approximately 85° C. indicating a crystalline structure. No thermal event was observed in the same material dried by spray freezing in accordance with the invention, indicating an amorphous structure. Both samples had a residual moisture content of between 3% and 4%.

It should be noted that the system used in the Example was an experimental laboratory-scale system only; it is to be expected that for a high quality system constructed from purpose-designed parts, the particle size will be limited only by the size of the droplets attainable in the spray.

Figure 4:
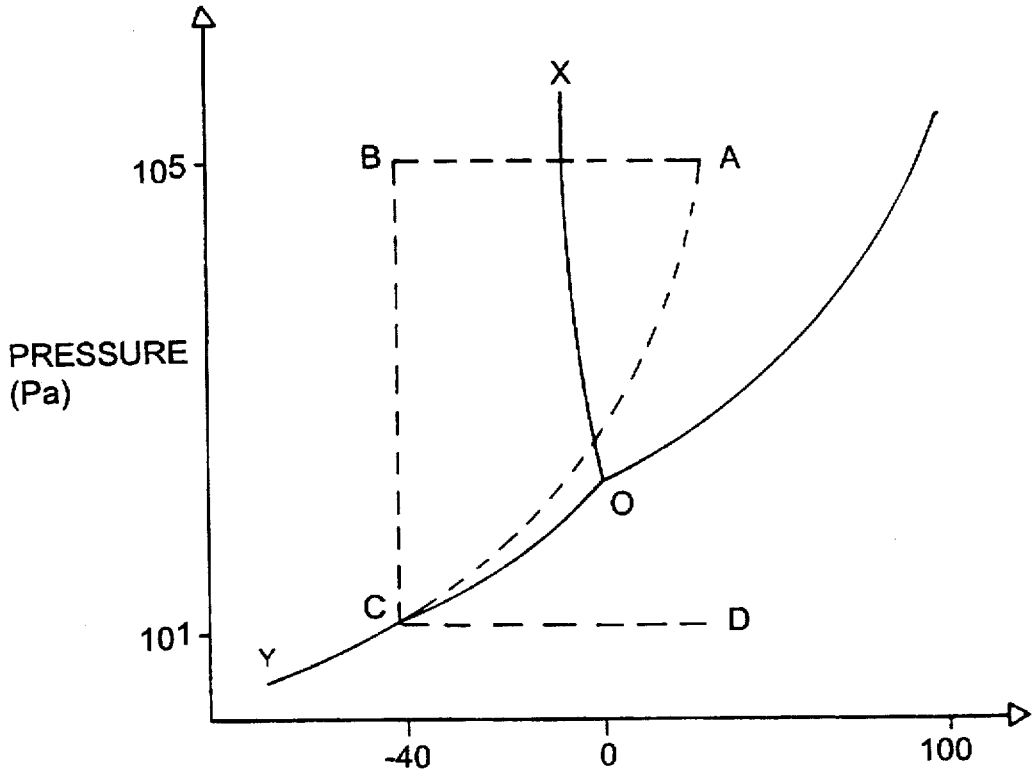
FIG. 4 shows a comparison of the process according to the invention and conventional lyophilisation, illustrated on a phase diagram of pressure and temperature.

FIG. 4 illustrates the difference between the process according to the invention and conventional freeze drying, or lyophilisation. During lyophilisation a liquid at A is cooled so that it crosses the solid-liquid phase line X-O. The cooling normally takes place at atmospheric pressure and results in a temperature drop to below the freezing point of the liquid, illustrated by the dotted line A-B. When frozen, a vacuum is established over the frozen liquid illustrated by the dotted line B-C. At a sufficiently low pressure sublimation commences with the solvent transgressing the solid-vapour phase line O-Y without going through the liquid phase. Vaporisation of solid is shown by the line C-D. In summary, lyophilisation is the progressive phase manipulation of liquid to solid to vapour as shown by the dotted line A-B-C-D.

In the process according to the invention a liquid spray at A is driven along the dotted line A-C by virtue of being subjected to a sudden vacuum. Vaporisation of liquid causes cooling of the droplet resulting in freezing followed by sublimation. The phase change from liquid to solid (A-C) is much more rapid than normal freezing and is preferably nearly instantaneous. Sublimation of the frozen droplet (C-D) follows a time course similar to normal lyophilisation.

I claim:

1. A process for obtaining a solid or semi-solid material by drying a solution thereof, comprising the steps of:

(a) subjecting the solution to vacuum-assisted freezing by introducing the solution into an evacuated chamber in the form of a uniform spray, the droplets of which are at a sufficiently low temperature to ensure that they freeze at the vacuum pressure inside the chamber; and (b) collecting the frozen droplets of solution on a collecting surface which is positioned in the chamber such that it collects the frozen solution and which is adapted to retain the droplets until they have been dried by sublimation, and controlling the temperature of the collecting surface and the pressure within the chamber so that the frozen solvent sublimes from the collected and retained frozen droplets, the collecting surface having been prepared by being brought to an initial temperature which is not greater than the melting point of the frozen solution at the initial pressure, which is the pressure within the chamber when the spray is introduced thereto, the temperature of the collecting surface and the pressure within the chamber being maintained throughout the sublimation process so as to prevent partial remelting of the frozen droplets as sublimation occurs.

2. A process according to claim 1, further comprising the step of cooling the solution, before it is introduced into the evacuated chamber, to a temperature just above the equilibrium freezing point of the solution.

3. A process according to claim 1, further comprising the step of supercooling the solution before it is introduced into the evacuated chamber.

4. A process according to claim 1, wherein the initial temperature of the collecting surface is such that sublimation of the solvent commences when the frozen droplets of solution contact the collecting surface.

5. A process according to claim 1, wherein the material obtained is in the form of particles which correspond in size to the original frozen droplets of spray.

6. A process according to claim 5, wherein the particle size is controlled by the rate of freezing of the droplets.

7. A process according to claim 1, wherein the controlling of the temperature of the collecting surface and of the pressure within the chamber ensures initially that the sublimation of the frozen solvent proceeds substantially to completion, and subsequently that the residual material is sufficiently heated to drive off substantially all remaining adsorbed solvent.

8. A process according to claim 1, wherein the controlling of the temperature of the collecting surface includes a step wherein the temperature of the surface is adjusted to compensate for the cooling effect of sublimation of the frozen solvent.

9. A process according to claim 1, wherein the material is a thermolabile substance.

10. A process according to claim 1, wherein the solution comprises two miscible solvents, each containing a solute soluble in one solvent but not in the other.

11. A process according to claim 1, wherein the droplets of spray have a mean diameter of 20 μm or less.

12. A drying apparatus for obtaining a solid or semi-solid material by drying a solution thereof, comprising:

a) a vacuum chamber into which a solution is introduced in the form of a spray;

b) means for evacuating the chamber to a sufficiently low pressure to cause the droplets of spray to undergo vacuum-assisted freezing upon introduction to the chamber;

c) a collecting surface positioned in the chamber such that it collects the frozen solution and a first temperature control means for controlling the temperature of the collecting surface, the collecting surface being adapted to retain the frozen droplets thereon until they have been dried by sublimation; and d) means for controlling the vacuum pressure such that sublimation of the frozen solvent takes place from the frozen solution.

13. A drying apparatus according to claim 12, further comprising a second temperature control means for controlling the temperature of the solution before it is introduced into the vacuum chamber.

14. A drying apparatus according to claim 12, wherein the vacuum chamber further comprises a condenser for condensing the solvent vapour.

15. A drying apparatus according to claim 12, wherein the collecting surface is one or more of the walls of the vacuum chamber.

16. A drying apparatus according to claim 12, wherein the collecting surface is a removable tray positioned within the vacuum chamber to collect the frozen droplets.

17. A drying apparatus according to claim 12, further comprising a spray nozzle for introducing the solution into the vacuum chamber in the form of a spray, and means for feeding the solution to the nozzle.

18. A drying apparatus according to claim 17, wherein the means for feeding the solution to the nozzle comprises means for cutting off the feeding of solution before any air is admitted to the chamber.

19. A drying apparatus according to claim 17, wherein the means for feeding the solution to the nozzle comprises an intermittent plunger to clear the aperture of the nozzle of frozen solution.

20. A drying apparatus according to claim 12, further comprising means for increasing the temperature of the dried solute after sublimation has taken place such that substantially all adsorbed solvent is removed from the solute.

* * * * *